US006494356B1

(12) United States Patent
Frank et al.

(10) Patent No.: US 6,494,356 B1
(45) Date of Patent: Dec. 17, 2002

(54) STAPLER

(75) Inventors: Stefan Frank, Stuttgart (DE); Martin Decker, Vaihingen (DE); Brigitte Radu, Ludwigsburg (DE); Horst Pfründer, Esslingen (DE); Gerhard Sieghart, Schlüsselfeld (DE); Theodor Pflugfelder, Nufringen (DE); Reiner Jüstel, Sindelfingen (DE); Walter Ohnmacht-Bezler, Stuttgart (DE); Peter Schwalk, Kornwestheim (DE); Günther Lehleiter, Vaihingen (DE); Thomas Schmaus, Sindelfingen (DE); Stefan Labonde, Böblingen (DE)

(73) Assignee: Esselte Leitz GmbH & Co. KG (DE)

( * ) Notice: Subject to any disclaimer, the term of this patent is extended or adjusted under 35 U.S.C. 154(b) by 0 days.

(21) Appl. No.: 09/743,299

(22) PCT Filed: Jul. 6, 1999

(86) PCT No.: PCT/EP99/04694

§ 371 (c)(1),
(2), (4) Date: Jan. 8, 2001

(87) PCT Pub. No.: WO00/02712

PCT Pub. Date: Jan. 20, 2000

(30) Foreign Application Priority Data

Jul. 9, 1998 (DE) ..... 198 30 603

(51) Int. Cl.[7] ..... B25C 5/16

(52) U.S. Cl. ..... 227/127; 227/134; 227/120

(58) Field of Search ..... 227/134, 127, 227/128, 123, 120

(56) References Cited

U.S. PATENT DOCUMENTS

| | | | | | |
|---|---|---|---|---|---|
| 2,147,380 | A | * | 2/1939 | Peterson | 227/134 |
| 2,340,717 | A | * | 2/1944 | Vogel | 227/127 |
| 2,358,317 | A | * | 9/1944 | Crosby | 227/127 |
| 2,801,414 | A | * | 8/1957 | Mueller | 227/127 |
| 6,142,355 | A | * | 11/2000 | Wu | 227/134 |
| 6,244,489 | B1 | * | 6/2001 | Laurie | 227/134 |

* cited by examiner

*Primary Examiner*—Scott A. Smith
(74) *Attorney, Agent, or Firm*—Pendorf & Cutliff

(57) ABSTRACT

The invention relates to a stapler comprising a base part (14) and a staple magazine (22) which is situated on a bracket of the base part (14) and which can pivot around a cross axis (16) in a limited manner. The stapler also comprises a spring-supported stable slide (28) which is guided to the head part (20) of the staple magazine in a sliding direction of said staple magazine. The invention device has a cap part (32) which carries a driver (30) that engages in the head part of the staple magazine. The cap part forms or comprises a limited manner. In order to refill the stapler with staples, the invention provides that the staple magazine (22) is connected to the base part (14) in a displaceably fixed manner, whereas the cap part (32) can be displace together with the magazine covering (34) along a slide guide with regard to the staple magazine (22) on the base part (14).

20 Claims, 7 Drawing Sheets

STAPLER

BACKGROUND OF THE INVENTION

1. Field of the Invention

The invention concerns a stapler with a base part carrying an anvil in its front area, with a staple magazine limitedly pivotable about a transverse axis on a mounting block in the rear area of the base part, with a staple pusher guided slideably in a slide guide of the staple magazine and spring biased towards to the head part thereof, with a cap part limitedly pivotable about the transverse axis relative to the staple magazine and relative to the base part, forming or including a magazine cover, the cap part carrying a driver which has a punch stroke extending into the head part of the staple magazine, and wherein the cap part, while taking along the staple pusher, and the staple magazine are slideable relative to each other between an operating position and a loading position, and with a locking mechanism for connecting the cap part with the staple magazine releaseably, fixed against sliding, in the operating position.

2. Description of the Related Art

Staplers of this type are known (DE-A 44 47 079), which include a spring compartment magazine, in which a magazine insert is slideable, relative to the base part and to the cap part, from an operating position into a loading position. The magazine insert, which is spring-biased, is pressed out of the rear side of the upper part into a loading position by operation of a push button or key. Spring compartment devices are somewhat more complex in their construction than so-called upper loading devices, of which the cover part is pivoted 180° about the transverse axis into a loading position for the refilling thereof and thereby the staple pusher is taken along against a spring force in the push guide of the staple magazine. The retraction of the pusher occurs thereby either via a pull spring or a pull slide bar. In both cases the cap part is under the direct or indirect influence of the spring which is acting upon the staple pusher, which is attempting to pivot the cap part back to its closed position. In order to prevent an undesired return pivoting of the cap part, it is releaseably locked to the base part in its folded-open loading position by means of a detent mechanism.

SUMMARY OF THE INVENTION

Beginning therewith, the present invention is concerned with the task of developing a stapler of the above described type, which comprises a loading mechanism which is simple to operate and easy to manufacture.

The inventive solution is based on the concept, that the staple magazine should be connected fixed against sliding with the base part, and that the cap part, in certain cases together with the magazine cover, should be slideable in a magazine fixed and/or a base part fixed slide guide relative to the base part. By this means it is achieved that the slide magazine can be opened for the refill process by sliding of the cap part over the rearward transverse axis.

A preferred embodiment of the invention envisions that the locking mechanism is formed as a detent mechanism between the staple magazine and cap part or magazine cover. The detent mechanism can include a key or push-button device manually operable directly or indirectly via the cap.

A preferred embodiment of the invention envisions that the slide guide includes at least one guide slot on the side of the magazine, with which the cap part, and/or a magazine cover connected thereto fixed against sliding, engages with at least one driver-side slide block or projection. The driver-side slide blocks are thereby preferably formed as pins, journals or tabs projecting sideways beyond the magazine cover, which extend or engage into the guide slots, which are inwardly open. The guide slots preferably include a slide segment oriented parallel to the slide direction and an end segment oriented parallel to the push direction of the driver, wherein the slide segment can transition into the end segment via a detent curve.

A further advantageous embodiment of the invention envisions that the slide guide includes at least a cap-side guide slot, in which at least one, preferably provided spaced apart radially from the pivot axis, base-part-side or magazine-side slide block engages. The cap-side guide slot thereby preferably exhibits a slide segment and a pivot segment, with the slide segment extending parallel to the slide direction and with the pivot segment contiguous therewith and which, when the cap is in the operating position, is oriented concentric to the pivot axis. The pivot segment insures that the cap part and the staple magazine are pivotable together about the pivot axis of the base part into a tacking position. For this purpose, on the base part there can be provided guide and securing groves lying diametrically oppositely to each other with respect to the pivot axis, and provided with the same radial separation from the pivot axis. In order to make possible an opening of the staple magazine by sliding of the cap part, the guide slot in the area of the pivot segment exhibits a transverse axis facing flank open on one side against the slide direction.

According to a further advantageous embodiment of the invention the magazine cover, with the cap part in the operating position, is lockable on the staple magazine preferably with the aid of a latching or detent mechanism. Further, the cap part in the operating position is engaged on the staple magazine limitedly pivotable, with respect to the magazine cover, in the punch direction of the driver against the force of a spring.

A further advantageous embodiment of the invention envisions that between the driver side end of the cap part or the magazine cover on the one hand, and the staple pusher on the other hand, a pull spring is provided, which for example can be constructed as a helical spring or as roll or coil spring. By this means it is achieved that the cap part together with the, in certain cases, slack or de-tensioned pull spring, and the staple pusher can be slid rearward into the loading position. Thereby it is achieved that no spring force acting in the direction of the closing position, which could represent a danger of injury, acts upon the cap part while in the loading position. Accordingly, the cap part does not need to be arrested to the base part when in the loading position, which would be necessary for example in the case of the conventional upper-loading staple device.

BRIEF DESCRIPTION OF THE DRAWINGS

In the following the invention will be described in greater detail on the basis of the illustrative embodiments shown in schematic manner in the figures. There is shown.

DETAILED DESCRIPTION OF THE INVENTION

Figure 1A:
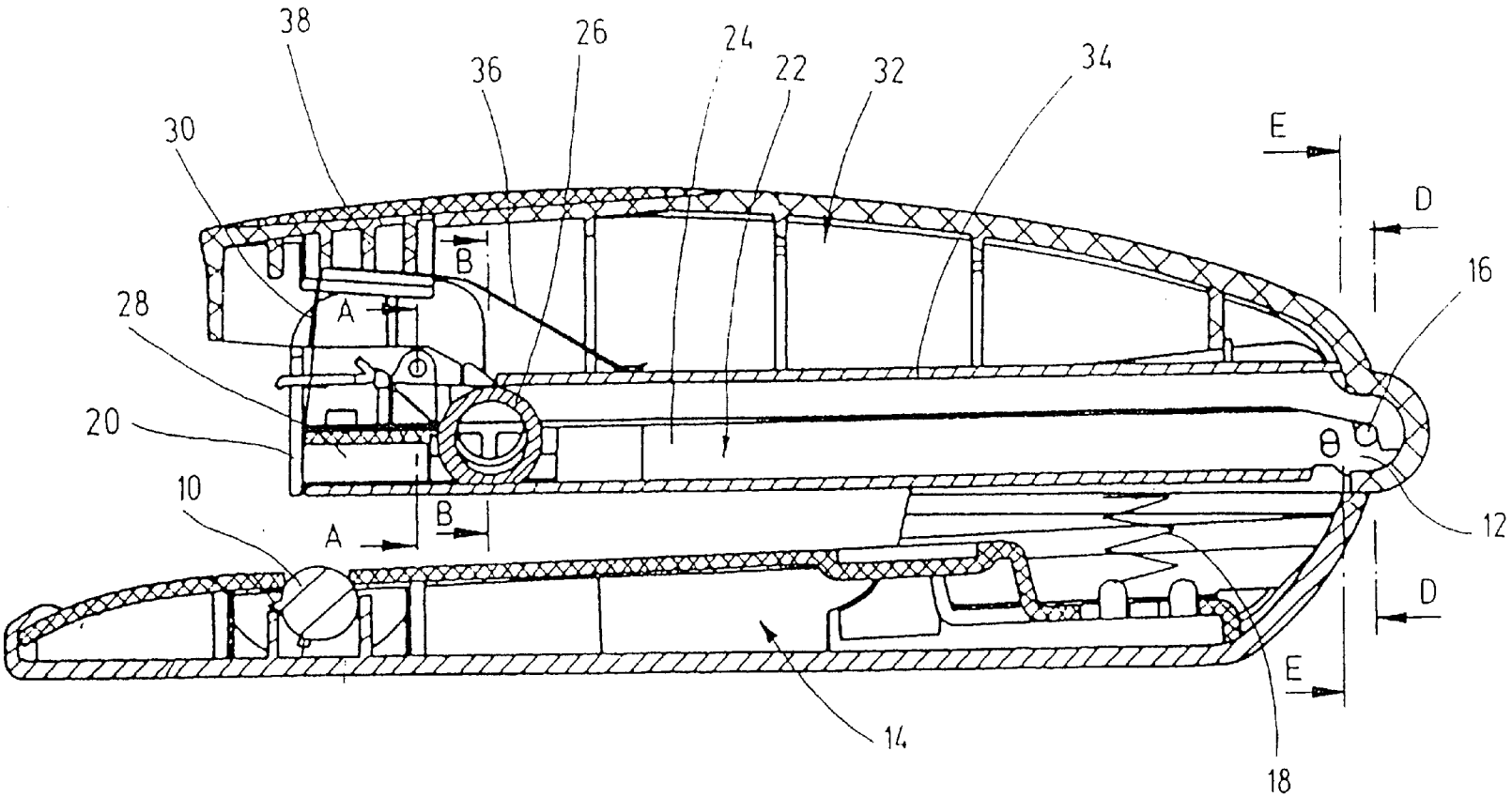
FIGS. 1*a* and *b*: a side view of a slide loading stapler in operating position and in loading position.

The stapler shown in the drawings is comprised essentially of a longitudinally extending base part 14, carrying in the front part thereof an anvil 10 and in its rearward area a mounting block 12, a staple magazine 22 mounted on the mounting block 12 and, from a rest position with its head part 20 elevated from the base part, limitedly pivotable against the force of a spring 18 about a transverse axis 16 in the direction of the anvil, a staple pusher 28 guided in a slide guide 24 of the staple magazine 22, urged in the direction of the head part 20 by a pull spring 26 shown in the illustrative embodiment as a coil spring, as well as a cap part 32 limitedly pivotable about the transverse axis 16 with respect to the staple magazine 22 and with respect to the base part 14, and carrying a driver 30 with a stroke extending into the head part 20 of the staple magazine. The staple magazine 22 is covered over by a magazine cover 34, against which the cap part is supported by a spring 36 and the cap part is connected with the driver 30, shown in the embodiment as a one-piece unit. The driver 30 is, together with the spring 36, form-fittingly anchored on a cap-side driver holder 38.

Figure 1B:
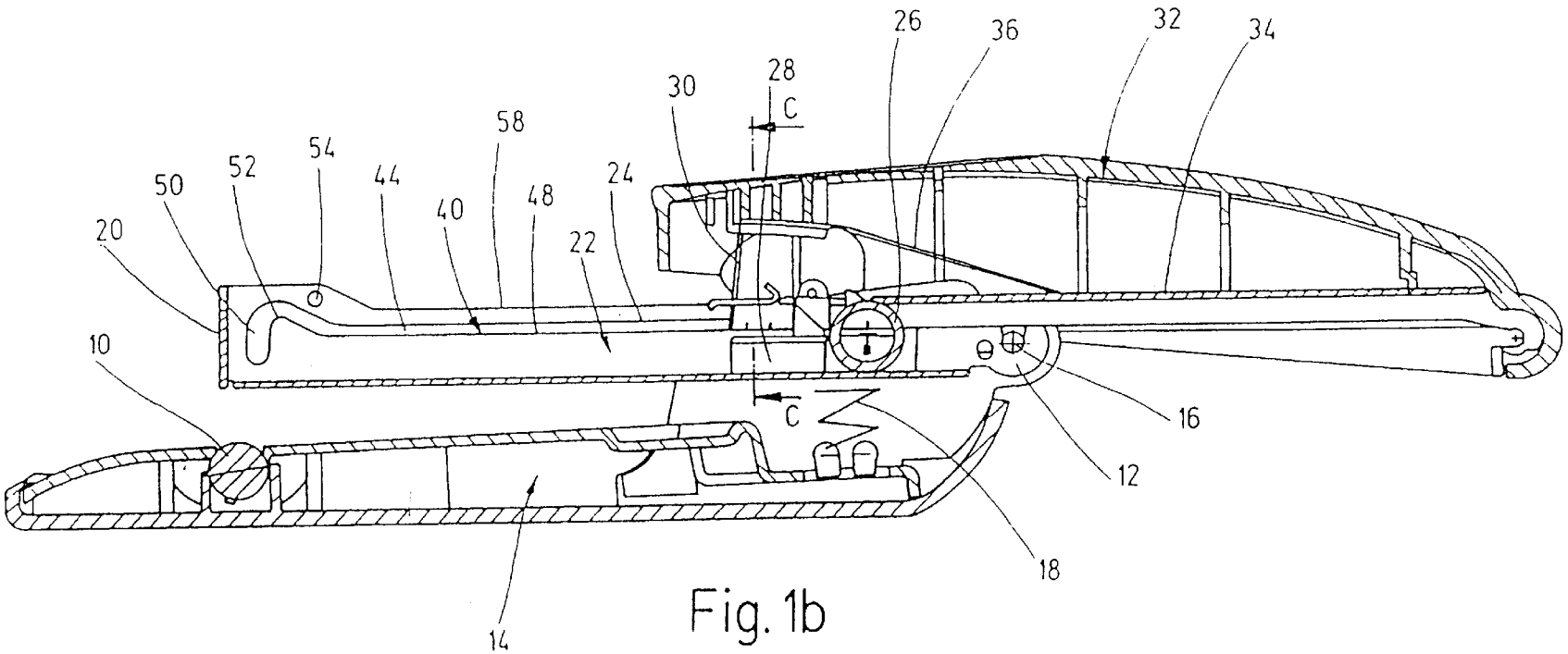
Figure 2:
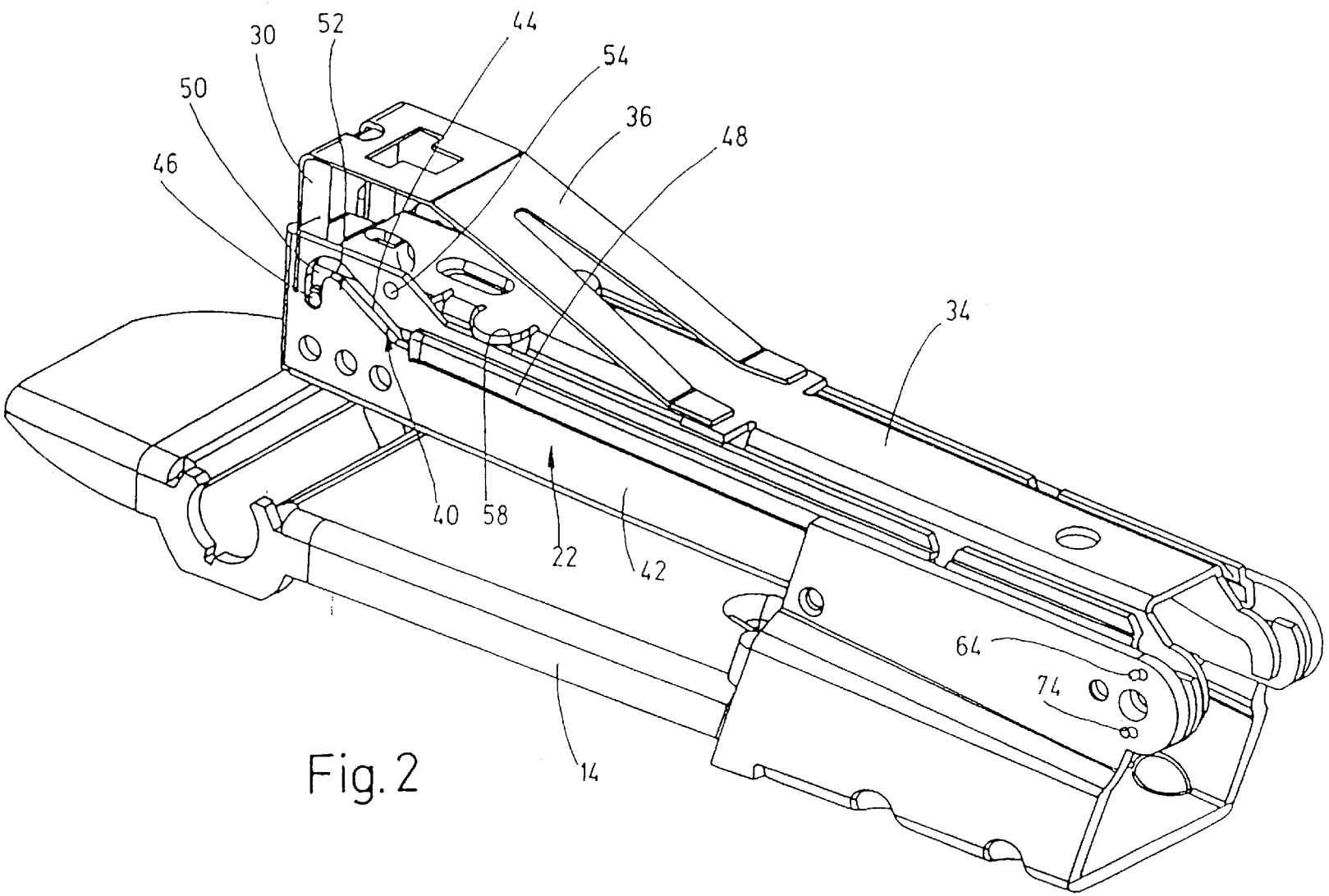
FIG. 2 a perspective representation of the stapler according to FIG. 1 without base part, cap part and anvil.

As can be seen from FIGS. 1 and 2, the staple magazine 22 is connected fixed against sliding with the base part 14, while the cap part 32 together with the magazine cover 34, with taking along of the staple pusher 28 and the spring 26, is slideable from an operating position (FIG. 1*a*) into a loading position relative to the staple magazine 22 and to the base part 14 (FIG. 1*b*). In the loading position the staple magazine 22 can be refilled from above with staples. The spring 26 is so tensioned in between the magazine cover 34 and the staple pusher 28 in the manner of a pull spring, that during sliding of the cap part 22 and the magazine cover 34 in the direction of the head part the staple pusher 28 is taken along via the spring 26 and the staples situated in the magazine are urged against the head part. In the loading position the spring 26 is free of pre-tension, so that the cap part remains in the loading position even without a locking mechanism.

Figure 4C:
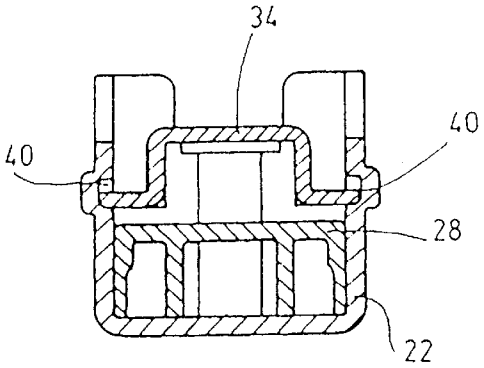
FIGS. 4*a* through *e* various segment representations along the segment lines A—A, B—B, C—C, D—D, E—E of FIGS. 1*a* and *b* in enlarged representation.
Figure 4B:
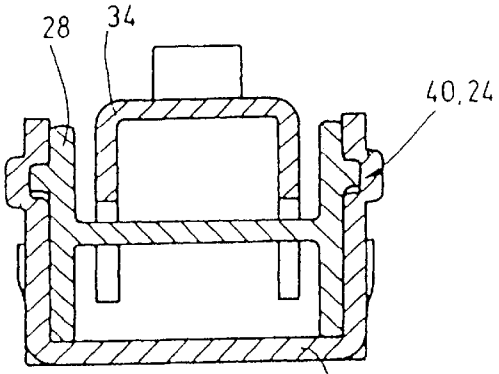
Figure 4A:
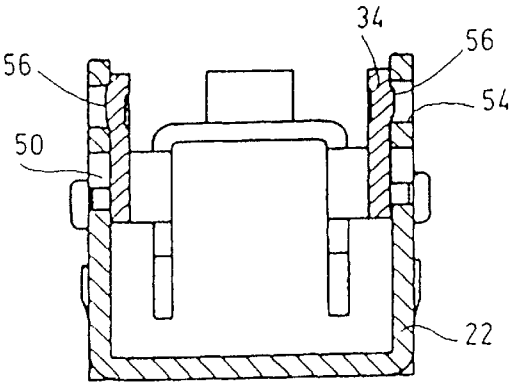
Figure 4E:
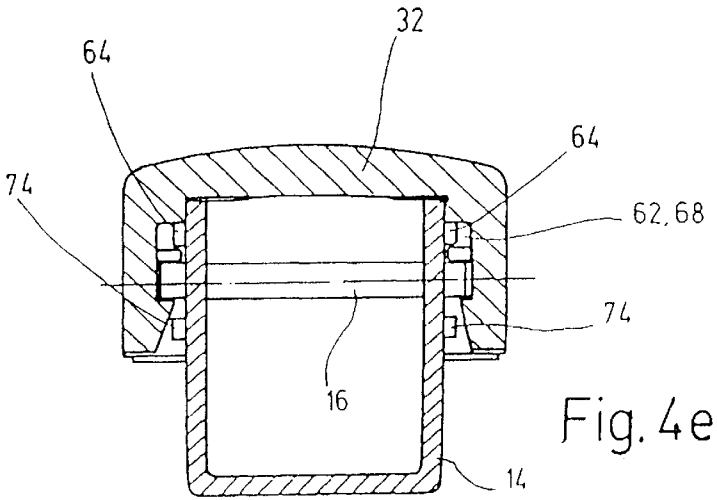

In order to maintain a defined direction of sliding between the cap part 32 and the staple magazine 22, a slide guide 40 is provided. The slide guide 40 includes two guide slots 44 in the side flanks 42 of the staple magazine 22 oriented in mirror-image to each other, in which the magazine cover 34, connected fixed against sliding with the cap part 32, engages with respectively one drive-side provided sliding block 46. The guide slots 44 exhibit respectively one slide segment 48 oriented parallel to the slide direction and one end segment 50 oriented perpendicular thereto and parallel to the stapling direction of the driver 30. The sliding segment 48 transitions into the end segment 50 via a detent curve 52. The sliding segments 48 are formed by two groves in the side flanks 42 of the staple magazine 22 open towards the magazine inside, at the same time serving as slide guide 24 for the staple pusher 28. In proximity to the driver side end of the staple magazine 22, in the side flanks 42 thereof, there are additionally situated detent recesses 54, lying opposed in mirror image to each other, in which the magazine cover 34 is releaseably engageable or lockable in the operating position with two detent cams 56 projecting towards the side (FIG. 4*a*).

For refilling, the magazine cover 34 is so lifted on the driver side via the cap part 32 that the detent cams 56 are extracted from the detent recesses 54 and the slide blocks 46 are lifted away in the end segments 50 of the guide slots 44 via the detent curves 52 and are pushed into the slide segment 48. Thereby the detent cams 56 leave the engagement area with the side flanks 42 of the staple magazine and move into an area above the upper edges 58 of the side flanks 42.

The slide guide 40 further includes two guide slots 62 provided on the side flanks 60 of the cap part 32 and formed as inwards open groves, oriented in mirror image to each other, in which respectively one base-part-side guide cam 64, radially displaced from the transverse axis 16, engages. The cap-side guide slots 62 exhibit a slide segment 66 oriented parallel to the slide direction, and a therewith connected pivot segment 68, which in the operating position of the cap part 32 is oriented concentric to the transverse axis 16. For assembly purposes the flanks 70 defining the guide slot 62 facing the transverse axis 16 are interrupted by a break 72 in the transition area between the slide segment and the pivot segment 68 and are open towards the transverse axis 16 perpendicular to the direction of slide. The later makes possible the sliding of the cap part 32 away over the transverse axis 16. Since in every slide position between the operating position and the loading position the pivot axis 16 is situated outside, and the guide cams 64 are situated within, the flanks 70 of the guide slots 62, the cap part 32 is locked in the slide condition against pivoting. In addition, the driver-side slide blocks 46 and the detent cams 56 contribute to the blocking thereof.

Figure 4D:
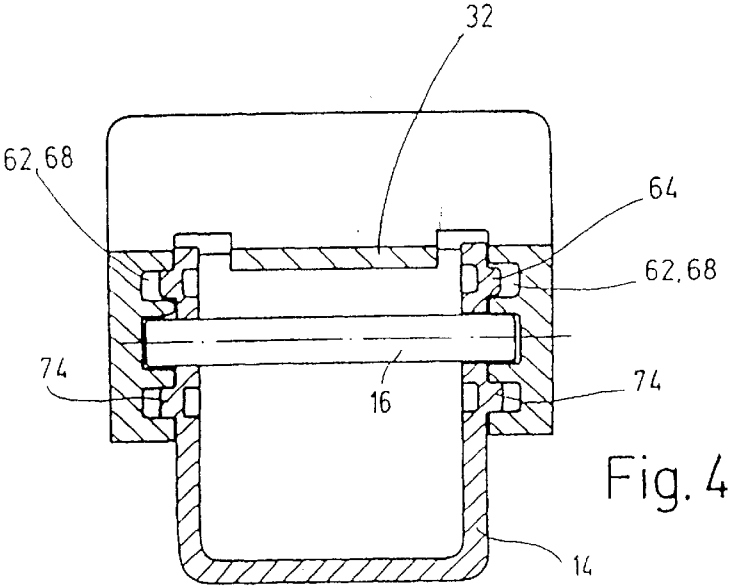

As can be seen from FIGS. 2, 4*d* and *e*, two further securing cams 74 are provided on the base part 14, diametrically opposed and lying in the same radial separation from the transverse axis 16 as the transverse axis of the guide cams 64, which engage in the pivot segment 68 of the guide slots 62. Therewith it is possible to pivot the staple magazine 22 together with the cap part 32 from the operating position shown in FIG. 1*a* of the stapler into a so-called tacking position with respect to the base part 14, pivoting about the transverse axis 16, without the possibility of any sliding between the cap part 32 and the slide magazine 22.

Figure 3:
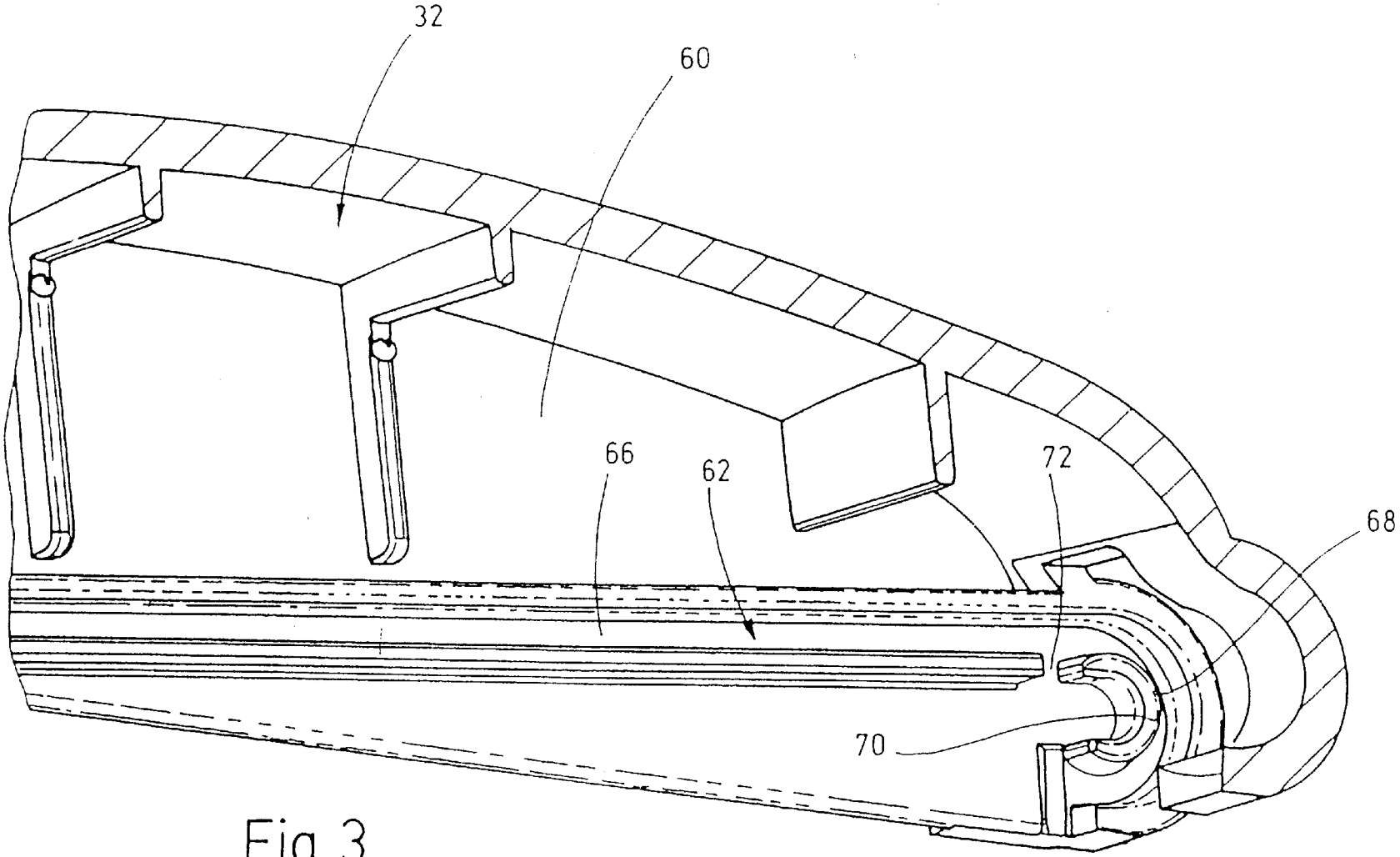
FIG. 3 a segment from the back area of the cap part in partial dissected, perspective representation.
Figure 5:
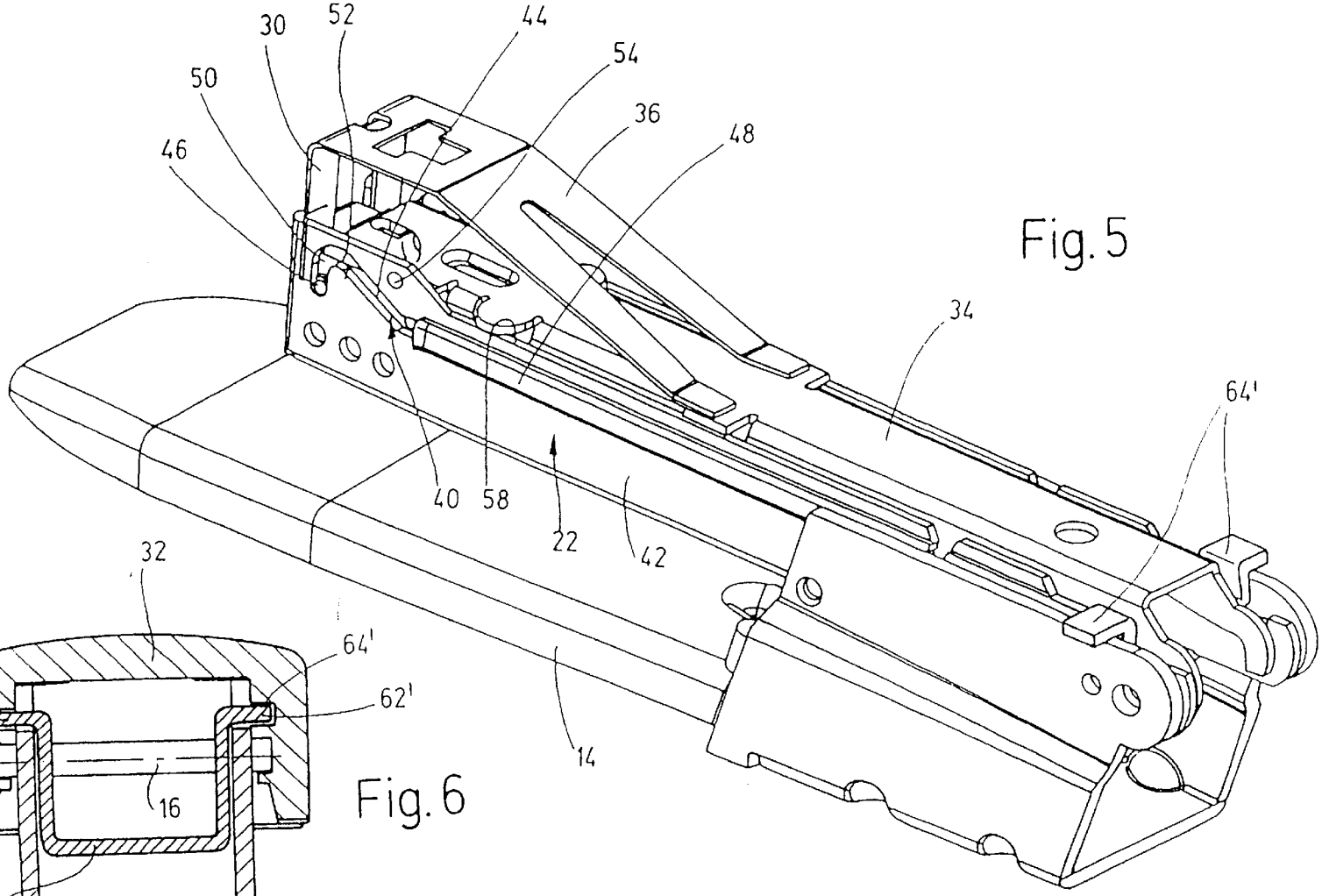
FIG. 5 a representation according to FIG. 2 for an alternative stapler.
Figure 6:
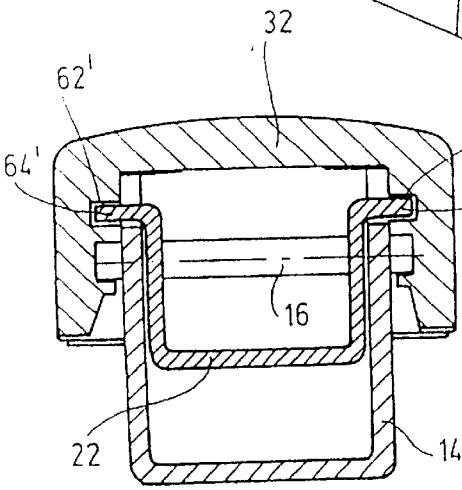
FIG. 6 a segment representation according to FIG. 4*e* for the stapler according to FIG. 5.
Figure 7A:
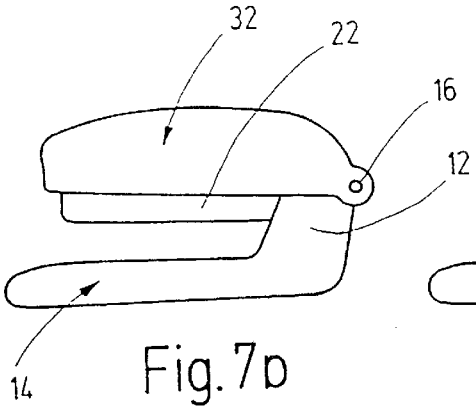
FIGS. 7*a* through *d* a side view of the slide loading stapler in operating position, tacking position, loading position and a possible intermediate position.
Figure 7B:
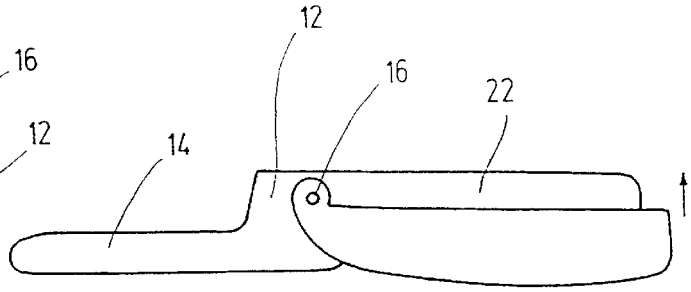
Figure 7C:
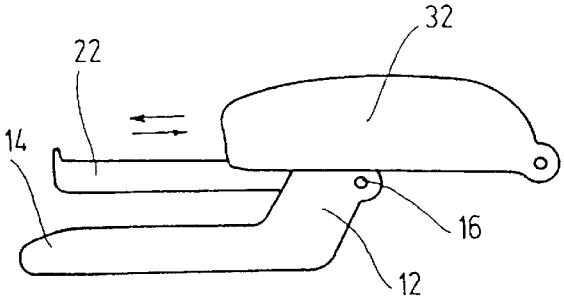
Figure 7D:
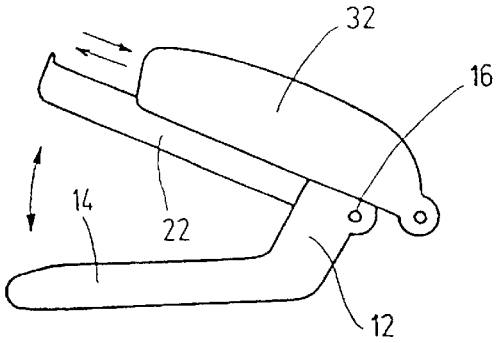

The illustrative embodiment shown in FIGS. 5 and 6 differs from the embodiment according to FIGS. 2 through 4 above all therein, that the guide and securing cams 64, 74 fixed to the base part are absent and in place thereof bar-shaped guide cams 64' are provided extending from the staple magazine 22, which engage in the guide slots 62' of the cap part 32. Therewith it is achieved, that the staple magazine 22 can be pivoted into the tacking position about the pivot axis 16 with respect to the base part 14 not only from the operating position according to FIG. 7*a* according to FIG. 7*b*, but rather also from the loading position according to FIG. 7*c* or from an intermediate position according to FIG. 7*d*. Thereby conditions conducive to malfunction, which could lead to a damaging of the stapler, are avoided.

In summary the following is to be concluded: The invention relates to a stapler comprising a base part 14 and a staple magazine 22 which is situated on a bracket of the base part 14 and which can pivot around a cross axis 16 in a limited manner. The stapler also comprises a spring-supported stable slide 28 which is guided to the head part 20 of the staple magazine in a sliding direction of said staple magazine. The invention device has a cap part 32 which carries a driver 30 that engages in the head part of the staple magazine. Said cap part forms or comprises a limited manner. In order to refill the stapler with staples, the invention provides that the staple magazine 22 is connected to the base part 14 in a displaceably fixed manner, whereas the cap part 32 can be displace together with the magazine covering 34 along a slide guide with regard to the staple magazine 22 on the base part 14.

What is claimed is:

1. A stapler comprising:

a base part having a front area and a rear area, and including an anvil in its front area and a mounting block in its rear area;

a staple magazine connected fixed against sliding with the base part, comprising a slide guide and including a head part and a rear part, wherein the rear part is mounted on said mounting block limitedly pivotable about a transverse pivot axis;

a staple pusher guided slideably in the slide guide of the staple magazine and spring-biased via spring means towards the head part;

a cap part limitedly pivotable relative to the base part and relative to the staple magazine about said axis transverse with respect to the staple magazine, the cap part including a magazine cover, the cap part carrying a staple driver having a stroke extending into the head part of the staple magazine; and a locking mechanism for releaseably fixing the cap part in the operating position to the staple magazine against sliding, wherein the cap part including magazine cover, taking along said staple pusher, is slideable relative to the staple magazine and the base part along said slide guide between an operating position and a loading position.

2. A stapler according to claim 1, wherein said locking mechanism is formed as a detent mechanism releasably connecting the cap part to the staple magazine.

3. A stapler according to claim 2, wherein the detent mechanism includes a release key manually operable via the cap part.

4. A stapler according to claim 1, wherein the pivot connection between the base part, the staple magazine and the cap part is disengaged when the cap part is slid out of the operating position.

5. A stapler according to claim 1, wherein the slide guide for guiding the cap part includes at least one guide slot associated with the magazine, in which the cap part, connected fixed against sliding thereto, engages with at least one slide block.

6. A stapler according to claim 5, wherein the guide slot includes a slide segment oriented parallel to a slide direction and an end segment oriented parallel to a stroke direction of the staple driver.

7. A stapler according to claim 6, wherein the slide segment of the guide slots transitions into the end segment via a detent curve.

8. A stapler according top claim 5, wherein the at least one slide blocks are formed as pins projecting sideways out of the magazine cover, which engage into the at least one guide slots of the staple magazine.

9. A stapler according to 1, wherein the slide guide includes at least one guide slot associated with the cap, in which at least one guide cam associated with the magazine engages.

10. A stapler according to claim 9, wherein said magazine cam is provided radially spaced from the pivot axis.

11. A stapler according to claim 9, wherein the guide slot associated with the cap part includes a slide segment oriented parallel to a slide direction and a pivot segment connected therewith which is concentric to the pivot axis when in the operating position.

12. A stapler according to claim 11, wherein the guide slot associated with the cap part, in the area of its pivot segment, includes a flank open towards the transverse axis and perpendicular to the slide direction.

13. A stapler according to claim 9, wherein two guide and securing cams are provided on the base part lying diametrically oppositely relative to the pivot axis, and having the same radial separation from the pivot axis.

14. A stapler according to claim 13, wherein the base-part associated guide and securing cams are formed as pins projecting from the mounting block, in radial separation from the transverse axis, and which engage into inwards open guide slots of the cap part.

15. A stapler according to claim 1, wherein the cap part and the staple magazine are pivotable together about the pivot axis of the base part.

16. A stapler according to claim 1, wherein when the cap part is in the operating position, the magazine cover thereof is lockable on the staple magazine.

17. A stapler according to claim 16, wherein said locking occurs via the detent mechanism.

18. A stapler according to claim 16, wherein the cap part when in the operating position is limitedly pivotable, against the force of a spring, relative to the magazine cover, which is locked to the staple magazine.

19. A stapler according to claim 1, wherein a pull spring is provided between the staple driver end of the cap part and the staple pusher.

20. A stapler according to claim 19, wherein the pull spring is a coil spring.

* * * * *